US006027540A

United States Patent [19]

Smith et al.

[11] Patent Number: 6,027,540

[45] Date of Patent: Feb. 22, 2000

[54] APPARATUS FOR REMOVAL OF PARTICULATE MATTER FROM GAS STREAMS

[75] Inventors: Peyton L. Smith; John C. Morse, both of Baton Rouge, La.

[73] Assignee: Destec Energy, Inc., Houston, Tex.

[21] Appl. No.: 08/823,035

[22] Filed: Mar. 31, 1997

[51] Int. Cl.[7] ..... B01D 46/12

[52] U.S. Cl. ..... 55/350.1; 55/485; 55/486; 55/488; 55/489; 55/525

[58] Field of Search ..... 55/267, 268, 269, 55/350.1, 482, 483, 484, 485, 486, 488, 489, 525, DIG. 20

[56] References Cited

U.S. PATENT DOCUMENTS 4,295,519 10/1981 Bellaff ..... 55/269
4,490,881 1/1985 Schmidt ..... 55/385.3
4,606,260 8/1986 Lox ..... 55/385.3
4,871,380 10/1989 Meyers ..... 55/484
5,261,946 11/1993 Overby ..... 55/269
5,290,330 3/1994 Tepper et al. ..... 55/510

*Primary Examiner*—Jay H. Woo
*Assistant Examiner*—Minh-Chau T. Pham
*Attorney, Agent, or Firm*—Vinson & Elkins, L.L.P.

[57] ABSTRACT

An apparatus for the removal of particulate matter from the gaseous product stream of an entrained flow coal gasifier which apparatus includes an initial screen, an intermediate screen which is aligned with the direction of flow of the gaseous product stream and a final screen transversely disposed to the flow of gaseous product and which apparatus is capable of withstanding at least a pressure differential of about 10 psi (68.95 kPa) or greater at the temperatures of the gaseous product stream.

10 Claims, 3 Drawing Sheets

APPARATUS FOR REMOVAL OF PARTICULATE MATTER FROM GAS STREAMS

The Government of the United States of America has rights in this invention pursuant to Cooperative Agreement No. DE-FC21-92MC29310 awarded by the U.S. Department of Energy.

FIELD OF THE INVENTION

This invention relates to the removal of particulate matter from gaseous streams containing such particulate matter. More particularly, this invention relates to the removal of particulate ash and unconverted carbonaceous particles from syngas streams produced by the gasification or partial gasification of carbonaceous matter.

BACKGROUND OF THE INVENTION

Three basic processes have been developed for the gasification of carbonaceous materials such as coal. They are: (1) fixed-bed gasification, (2) fluidized-bed gasification, and (3) suspension or entrainment gasification. The present invention relates to the third type of process, suspension or entrainment gasification.

One method of carrying out an entrainment gasification process to produce synthesis gas, hereafter "syngas", is described in U.S. Pat. No. 4,872,886 to Henley. In that process, a two-stage gasification reaction in a non-catalytic, fired horizontal slagging reaction zone, or first stage reactor, a stream of oxygen-containing gas is reacted with a first increment of a slurry of particulate carbonaceous solids in a liquid carrier at temperatures from 2400° F. (1316° C.) to 3000° F. (1649° C.). The oxygen, carbonaceous solids and liquid carrier are converted into steam, vapor from the liquid carrier, char, slag and gaseous combustion products. The slag which forms in the reactor flows by gravity to the bottom of the reactor and out of the reactor through a tap hole. In a second stage, the steam, vapor from the liquid carrier, char and gaseous products from the fired horizontal reactor are contacted, in an unfired vertical second stage reactor, with a second increment of slurry of particulate carbonaceous solids in a liquid carrier to yield steam, vapor from the liquid carrier, syngas and char entrained in the gaseous effluent. In addition, small sticky slag droplets are entrained and will tend to adhere to and foul surfaces which they contact. The temperature at which the slag droplets solidify ranges over a wide band of temperatures usually upwards of about 1700° F. (927° C.). During this sticky phase these molten slag particles or droplets exhibit sufficient stickiness that they can cause extreme difficulties in processing because the particles or droplets adhere to and form deposits on walls, valves, outlets, and the like of process equipment downstream of the gasifier. Usually, one such piece of downstream equipment is a high temperature heat recovery unit or boiler, which in the case of Henley U.S. Pat. No. 4,872,886 is a fire-tube boiler. The fire-tube boiler has the product dirty syngas flow through the tubes and the heat exchange fluid, usually water, flows on the shell side. While it is considerably more economical to use a fire-tube boiler from the standpoint of capital expense, the plugging of the tubes creates a disadvantage of increased maintenance expense. Because the feed coal slurry is finely divided, any char particles and the slag droplets would normally pass through the tubes of a fire-tube boiler. However, the agglomeration of particles within the passageways of the reactor gaseous exit piping, the sloughing off of deposits which have previously built up on the walls and other points of flow interruption within the reactor passageways and the coating and build up of deposits in the entrance of the boiler, all cause the narrowing of the boiler tube openings which increases pressure drop across the boiler and eventually plugs the boiler tubes. It is therefore desirable to provide a system or apparatus which will prevent the plugging of the boiler or at least delay such plugging or pressure drop increase for as long as possible prior to having to shut down the gasifier and clean out the boiler tubes.

Various filters have been attempted but have proven unsatisfactory because they either blind themselves too quickly or when partially blinded can not withstand sufficient pressure drop themselves without collapsing. It has now been found that a combination of various filter screens allows small particles of char and slag to pass through the tubes of a fire-tube boiler without plugging while still preventing the larger particles of char-slag agglomerate or sloughed off deposits to be caught and held away from the entrance to the fire-tube boiler tubes and still allow the dirty syngas to pass through the screen combination at reasonable pressure drops.

This combination of advantages has been found to provide satisfactory use in a coal gasification process which has operated under commercial conditions, allowing continued operation for reasonable periods of time. These and other objects and advantages are accomplished in accordance with the present invention as described hereinbelow.

SUMMARY OF THE INVENTION

The present invention provides an apparatus for removing particulate matter from a gas stream prior to entry into a heat exchanger, having a longitudinal axis with an upstream end and a tubesheet thereacross, to prevent fouling and plugging thereof by the particulate matter, in which the apparatus comprises in combination (a) a final screen means adjacent the tubesheet and upstream thereof from the gas flow direction and having a supported wire mesh means located in a plane transverse to the longitudinal axis of the heat exchanger and having a central support portion; (b) an intermediate screen means being supported on the central support portion of the final screen means and having at least one cylindrical structure oriented with a longitudinal axis parallel to the longitudinal axis of the heat exchanger and including a plurality of longitudinally disposed, apertured internal support members and a plurality of transversely disposed internal support members, such that together the internal support members form a plurality of sections which are covered at their periphery with wire mesh means; and (c) an initial screen means having a supporting frame structure to which is attached a wire mesh means and being located upstream of the intermediate screen means. The combination of screen means is able to withstand up to about 10 pounds per square inch (68.9 kPa). Preferably, the wire mesh means is composed of a nickel and chromium containing alloy.

BRIEF DESCRIPTION OF THE FIGURES OF THE DRAWINGS

The apparatus of the present invention can be more easily described by reference to the Figures of the Drawings. In each of the Figures, which are not to scale, like numbers represent the same parts.

DETAILED DESCRIPTION OF THE INVENTION

Figure 1:
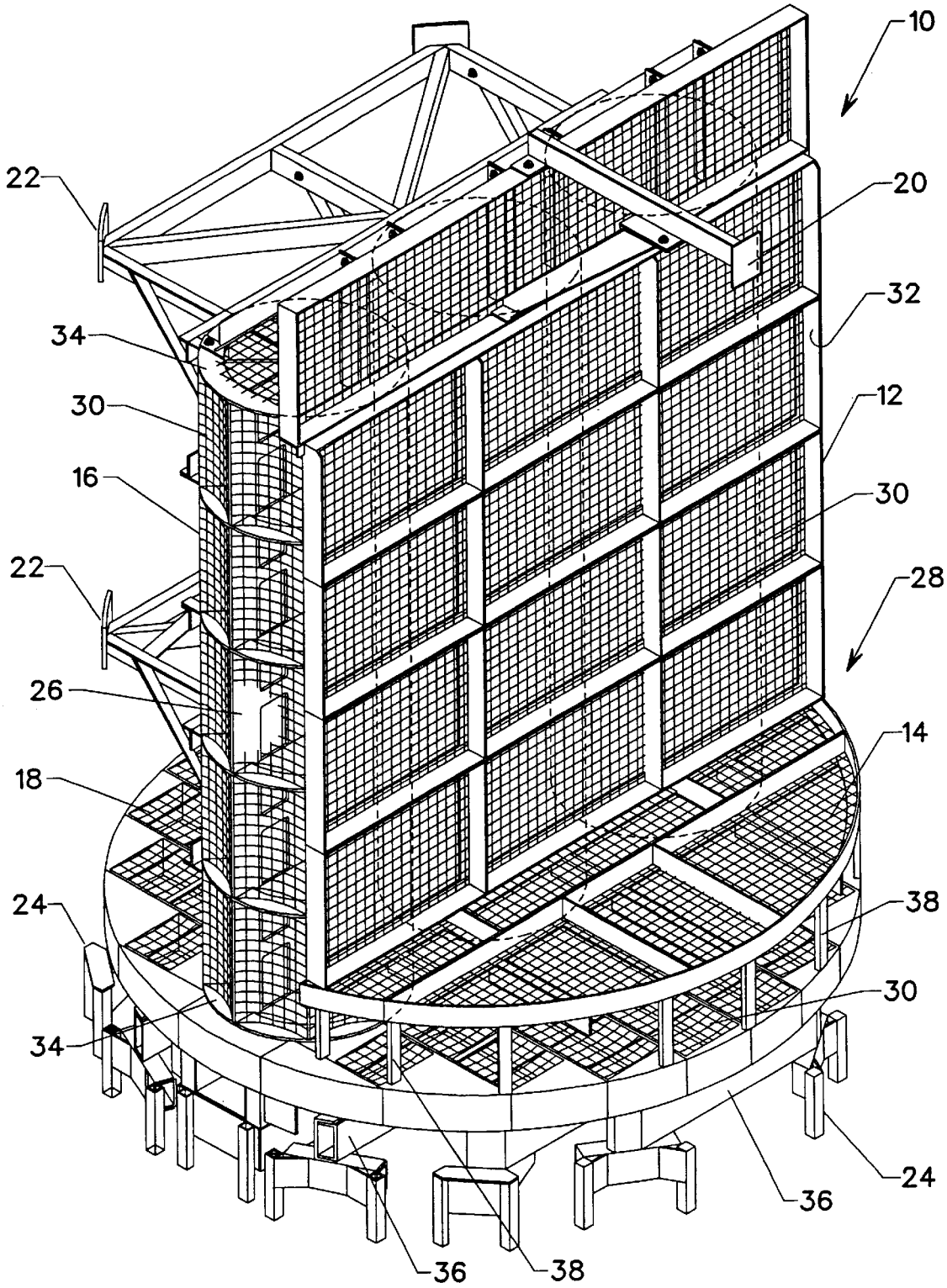
As shown in FIG. 1, the invention is shown in a partial cut out perspective view with hidden lines showing the outline of several cylindrical structures forming the intermediate screen means. Various supports and braces are shown as they would connect with points on the vessel walls (which are not included), but are not a part of the invention itself.

The gasification of carbonaceous materials, such as entrainment or suspension processes, presents a high temperature, high pressure environment with corrosive and erosive gaseous streams flowing in the process piping and equipment. Deposits of slag, ash and char coat internal surfaces and when such deposits break off and are suspended or entrained with the other entrained solids severe plugging problems are presented. One area which has the potential to quickly plug and require the process to be shut down is the high temperature heat recovery system. In one embodiment of the present invention, a fire-tube boiler used as a high temperature heat recovery apparatus is protected from agglomerates of ash, char and slag, from sloughed off deposits and from build up of deposits by an apparatus for removing such particulate matter in the gaseous effluent from an entrained flow gasifier. Typically, the fire-tube boiler is a cylindrical vessel which can be vertically or horizontally disposed and has a longitudinal axis with tubesheets at both ends to affix and align the tubes carrying the process gas. The shell side carries a heat transfer fluid, preferably water, which is used to convey heat away from the process gas and recover steam. In order to prevent plugging of the tubes of the fire-tube boiler, a combination of screen means is employed prior to entry of the gas into the fire-tube boiler or any similar heat exchange device. Preferably, the screen means combination is adjacent the tubesheet and includes a final screen means ahead of the heat exchanger in the gas flow direction having a wire mesh screen material on a supporting frame such that the wire mesh prevents entry into the heat exchanger of particles large enough to cause plugging. While this final screen means will prevent plugging of the heat exchanger or fire-tube boiler or the like, the final screen means, if used by itself, tends to plug quickly and because of its flat planar structure can withstand a pressure drop of only about 3.5 to about 4 pounds per square inch (psi) (24.1 to about 27.6 kPa). Therefore, the final screen by itself is not able to function effectively to prevent plugging the heat exchanger with any degree of continued processing capability. The final screen means has a central portion which provides support for the combined intermediate screen means.

The intermediate screen means is further upstream of the final screen means and is supported by the central portion of the final screen means. The intermediate screen means can be any structure which has an elongated structure in comparison to the flat planar structure of the final screen means. That is, the intermediate screen means has a general planar axis transverse to that of the final screen means and generally in alignment with the longitudinal axis of the heat exchanger. Preferably, the intermediate screen means is at least one curved structure having internal support means which is covered about its periphery with a wire mesh material. More preferably, the central support area of the final screen means supports three curved structures which have longitudinal axes transverse to the plane of the final screen means and which are parallel to the longitudinal axis of the heat exchanger. Most preferred is an intermediate screen means which is a cylindrical structure having its longitudinal axis transverse to the plane of the final screen means and in parallel to the longitudinal axis of the heat exchanger, in which the cylindrical structure of the intermediate screen means has a plurality of longitudinal support members and a plurality of transverse support members which form a plurality of supporting sections which are covered by wire mesh material. Because the intermediate screen means has its longitudinal axis (or axes when there is more than one structural member) transverse to the plane of the final screen, the gas flow through the intermediate screen does not tend to blind, web over or become fouled, except after a more than expected time period in comparison to the final screen means used alone. Likewise, because of the gas flowing in the longitudinal direction of the intermediate screen axis (or axes) and its decreased tendency to blind, the pressure drop across the intermediate screen is lower and the intermediate screen means can withstand up to about 10 psi (68.9 kPa) or more, such as about 50 psi (344.74 kPa).

Ahead or upstream of the intermediate screen means, the initial screen means acts to protect the other two screen means from fouling by larger agglomerates or sloughed off deposits. The initial screen means requires more rugged construction because it first encounters the hot gases and largest pieces of particulate matter. One embodiment of the initial screen means includes a supporting frame structure to which is attached a wire mesh material. Preferably, the initial screen means covers the entire intermediate screen means in the passageway leading from the gasification reactor to the high temperature heat recovery system. The gaseous effluent stream has no path for by-passing the initial screen means, except to pass over the initial screen means where it is caught by the top of the intermediate screen means. However, this rarely happens until the initial screen means is heavily blinded.

In a more preferred embodiment, the initial screen means is in the form of an L-shaped screen means having an upper portion which is in a plane transverse to the plane of the final screen means and a lower portion which is in a plane parallel to the plane of the final screen means.

As constructed in a most preferred embodiment and as shown in FIG. 1, the apparatus 10 of the present invention is located at the top of a vertically disposed high temperature heat recovery system, such as a fire-tube boiler, not shown. The gaseous product stream from the gasification reactor is led via an inlet pipe into the top of the fire-tube boiler vessel and makes a 90° downward turn passing through the apparatus 10 of this invention before entry into the fire-tube boiler.

As the gaseous product stream passes into the top of the heat recovery section, the gas first encounters the initial screen means 28, which has vertical portion 12 and horizontal portion 14. Vertical portion 12 has generally rectangular supporting frame members 32 which support wire mesh material 30 which acts as the screening device to remove the particulate matter from the gaseous product stream. The type of supporting structure, such as supporting frame members 32 is entirely a matter of choice and convenience and nothing critical is known with regard to the shape of the supporting frame members 32. Supporting frame members 32 could also be in the form of other geometric shapes, such as triangles, circles, squares, etc. It is only required that the initial screen 28 formed with the aid of supporting frame members 32 have sufficient strength to withstand pressure drop of about 0.5 psi (3.45 kPa) and the impact of the particulate matter in the gaseous product stream flowing at a velocity of about 80 feet per second. Horizontal portion 14 of the initial screen means 28 in this preferred embodiment is attached to the vertical portion 12 at the lower edge and forms therewith an L-shaped member. Horizontal portion 14 also is constructed with supporting frame members 32 and conforms generally to the shape of the vessel holding the high temperature heat recovery system, which in this preferred embodiment is a cylinder. Thus, horizontal portion 14 has its outer periphery shaped in the form of a portion of the circumference of a circle.

Both vertical portion 12 and horizontal portion 14 are covered by a wire mesh material 30. The wire mesh material 30 is attached to vertical portion 12 and horizontal portion 14 by any known method, such as by welding or mechanical fasteners for example. The materials of construction for wire mesh material 30 is any metal that can withstand the temperatures and corrosive and erosive atmosphere of the gaseous product stream, such as various steel alloys most suitable for such service. Typically, steel alloys having nickel and chromium, such as Inconel™ 617, a trademark of Inco Alloys International, Inc. of Huntington, W. Va., give satisfactory service in corrosive environments. Additionally, the Incoloy™ series of alloys, such as, Incoloy™ 800HT have desirable characteristics useful for this type of atmosphere. "Incoloy" is also a trademark of Inco Alloys International, Inc. Similarly, the wire mesh material 30 used in this initial screen means 28 can also be used on other sections of the present invention.

Figure 2:
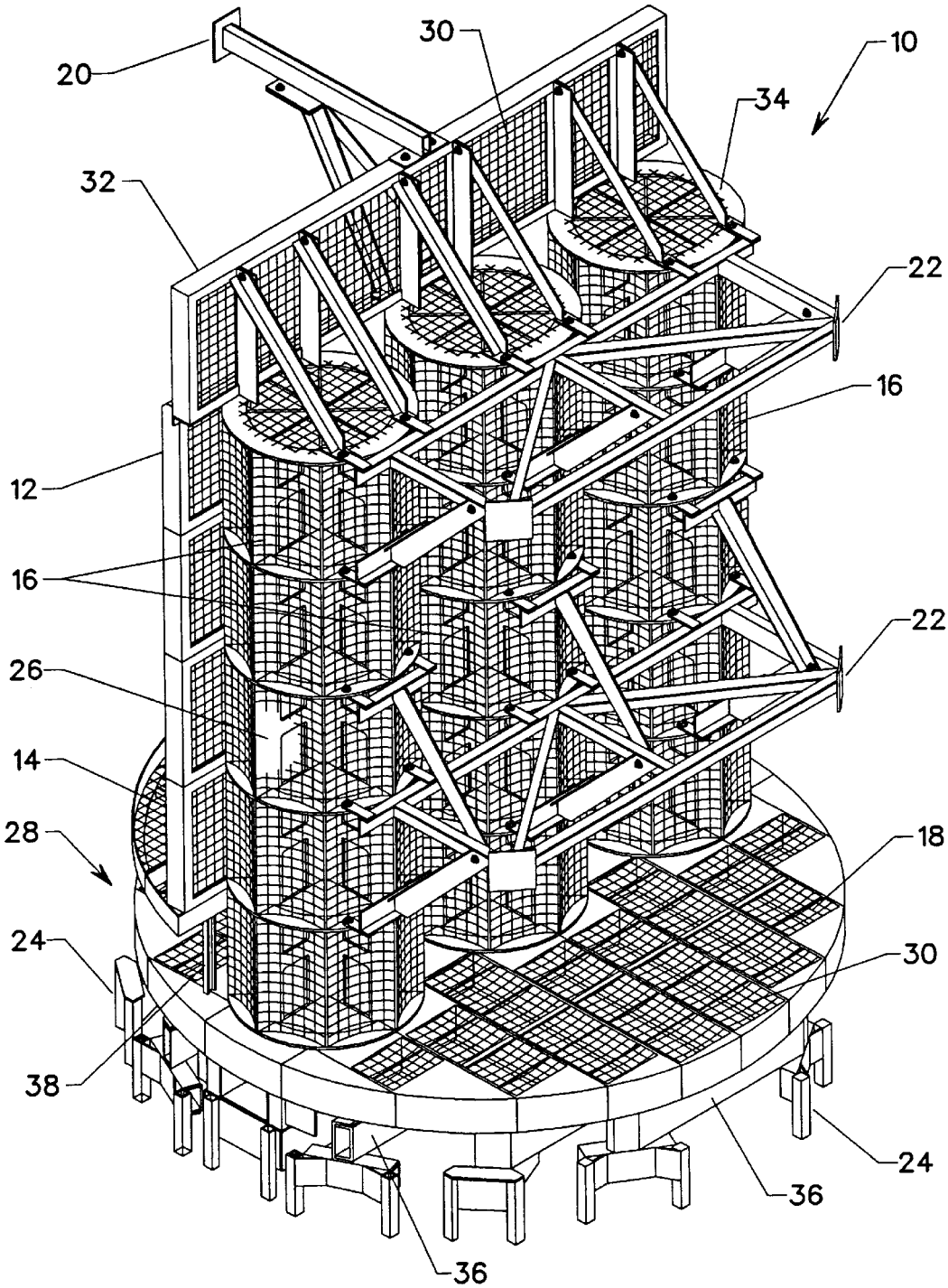
FIG. 2 shows the reverse angle of FIG. 1 also in partial cut out perspective. The three cylindrical structures of the intermediate screen members are now more apparent than from FIG. 1.
Figure 3:
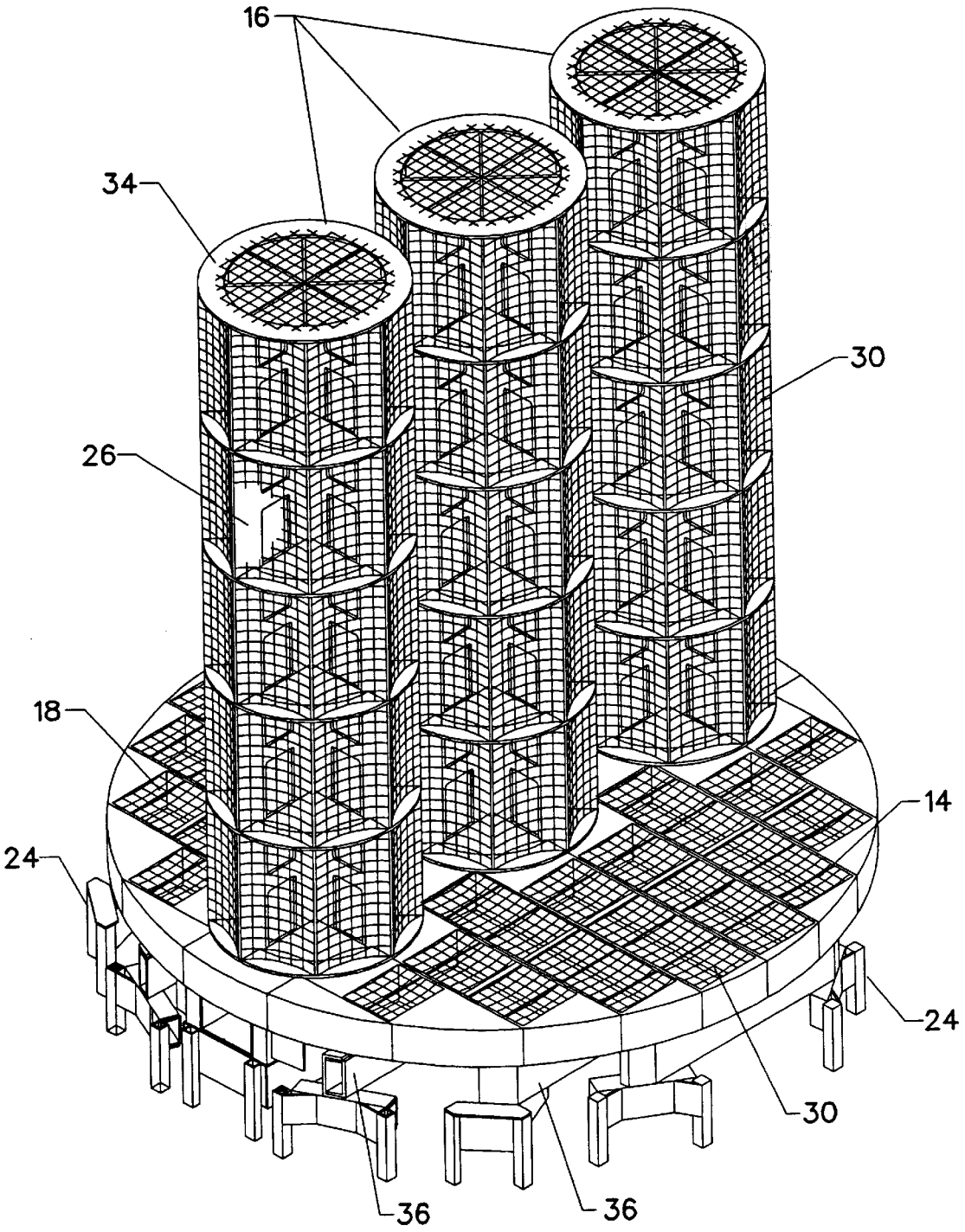
FIG. 3 shows a part of the invention without the initial screen member for clarity of viewing the intermediate screen structure and is a partial cut out perspective view.

Attached adjacent to the initial screen means 28 is intermediate screen means 16. As shown in the preferred embodiment of FIGS. 1, 2, and 3, intermediate screen means 16 is composed of three cylindrical structures or risers, each of which are substantially identical, but need not be. Vertical internal support members 26 and horizontal internal support members 34 are used to support wire mesh material 30 in the intermediate screen means 16. A plurality of vertical internal support members 26 can be employed to provide uniform support around the cylindrically shaped structure and, in transverse cross-section through the cylindrical shape, appear as spokes of a wheel. Each of the vertical internal support members 26 is apertured for the passage of the gaseous product stream, the apertures being large enough not to contribute to plugging of the apparatus 10, but still small enough that the vertical internal support member maintains sufficient structural strength to withstand the aforementioned pressure drop. The horizontal internal support members 34 are, in this cylindrical embodiment of intermediate screen means 16, conveniently in the shape of a flat toroidal ring. The open center of the ring provides for passage of the gaseous product stream and the edge of the ring horizontally stabilizes the vertical internal support members 26. Appropriate attachment between the horizontal and vertical support members 34 and 26, respectively, strengthens and stiffens the entire structure of intermediate screen means 16. FIG. 3 shows the apparatus 10 without the initial screen means 28 so that intermediate screen means 16 can be more easily seen. Also, shown is the top of the cylindrical structures or risers covered with wire mesh material 30.

Intermediate screen means 16 is supported by the central portion of final screen means 18 which in this preferred embodiment is in the shape of a flat, circular plate covered with wire mesh material 30, except in the central portion which are typically metal plates. The final screen means is supported by a plurality of support beams 36 which are not a part of the invention, but are merely used to support the apparatus 10 as a whole. The support beams 36 are in turn connected to vertical supports 24 which are attached to the vessel wall and/or the tubesheet (not shown) of the heat exchanger or fire-tube boiler. Horizontal braces or supports 22 are attached by welding or mechanical fasteners to the intermediate screen means 16 and to the vessel walls. One or more horizontal stabilizers 20 attached to the initial screen means 28 and the vessel walls ensures that the initial screen means maintains its intended position. Additionally, a number of initial screen vertical supports 38, which may be the same or different from vertical supports 24 are used to maintain the horizontal portion 14 in position.

The wire mesh material 30 generally has quadrangular openings between the wires which are greater than about 0.625 inches (1.588 cm). Preferably, the quadrangular openings in the wire mesh material 30 range from about 0.625 inches (1.588 cm) to about 0.75 inches (1.9 cm).

While the apparatus of this invention is designed to remove particulate matter from the syngas stream, the size of the particulate matter, which is mostly char, and the size of the openings in the wire mesh material together with the size of the heat exchanger tubes will insure that the smaller particles will flow through the system and must be removed and recovered for recycle to the gasifier by other means. It is sufficient that an orderly campaign of production of syngas can be carried out for weeks and months at a time or longer when using the apparatus of the present invention.

In general, the apparatus 10 of the present invention must be composed of materials which can withstand the temperature of the gaseous product stream, typically above about 1700° F. (927° C.). The pressure within the system can range from about 350 psig (2,413.2 kPa) to about 450 psig (3,102.6 kPa) and should be able to withstand a pressure differential of about 10 psig (68.95 kPa).

Having described at least one preferred and nonlimiting embodiment of the present invention, one skilled in the art can envision numerous variations and alternatives thereof. Therefore, it is desired that the present invention be limited only by the lawful scope of the following claims.

What is claimed is:

1. An apparatus for removing particulate matter from a gas stream prior to entry into a heat exchanger, said heat exchanger having a longitudinal axis with an upstream end and a tubesheet thereacross, to prevent fouling and plugging thereof by said particulate matter, said apparatus comprising in combination a) a final screen means adjacent said tubesheet and upstream thereof from the gas flow direction and having a supported wire mesh means located in a plane transverse to the longitudinal axis of said heat exchanger and having a central support portion;

b) an intermediate screen means located upstream from said final screen means and being supported on said central support portion and having at least one cylindrical structure oriented with a longitudinal axis parallel to the longitudinal axis of said heat exchanger and including a plurality of longitudinally disposed, apertured internal support members and a plurality of transversely disposed internal support members, such that together the said internal support members of said intermediate screen means form a plurality of sections, said sections being covered with wire mesh means; and c) an initial screen means having a supporting frame structure to which is attached a wire mesh means and being located upstream of the intermediate screen means.

2. The apparatus of claim 1 wherein said intermediate screen means comprises at least 3 cylindrical structures.

3. The apparatus of claim 1 wherein the wire mesh of said final screen means, said intermediate screen means and said initial screen means has quadrangular openings greater than about 0.625 inches or 1.588 cm.

4. The apparatus of claim 3 in which said quadrangular openings are square and range from about 0.625 inches or 1.588 cm to about 0.75 inches or 1.9 cm on a side.

5. The apparatus of claim 1 in which the wire mesh is composed of a chromium-nickel alloy.

6. The apparatus of claim 1 which has a resistance to failure across the apparatus from the downstream side to the upstream side of at least about 10 pounds per square inch or 68.95 kPa.

7. The apparatus of claim 1 in which said initial screen means is adjacent said intermediate screen means.

8. The apparatus of claim 1 in which said initial screen means has an upper portion which is in a plane transverse to the plane of the final screen means and a lower portion which is in a plane parallel to that of said final screen means.

9. The apparatus of claim 8 in which said initial screen means is L-shaped with said upper portion being the vertical portion of the L-shape and said lower portion being the horizontal portion of the L-shape.

10. The apparatus of claim 1 in which each of said final screen means, said intermediate screen means and said initial screen means are attached together.

* * * * *